United States Patent [19]

Grossman

[11] Patent Number: 5,062,670

[45] Date of Patent: Nov. 5, 1991

[54] LOCK MONITOR

[76] Inventor: Emanuel Grossman, 1555 Finch Ave. E., Suite 1105, Willowdale, Canada

[21] Appl. No.: 601,648

[22] Filed: Oct. 23, 1990

[51] Int. Cl.[5] ..... E05C 1/112; H01H 27/00

[52] U.S. Cl. ..... 292/137; 292/DIG. 65; 200/61.64; 200/61.68; 70/434

[58] Field of Search ..... 200/61.64, 61.67, 61.68; 70/DIG. 49, 432, 434, 441; 292/DIG. 65, 137, 92; 340/342, 345

[56] References Cited

U.S. PATENT DOCUMENTS

| | | | |
|---|---|---|---|
| 3,803,57 | 4/1974 | Gotanda | 200/61.64 |
| 484,233 | 10/1892 | Nolley | 200/61.68 |
| 1,265,361 | 5/1918 | Muringer | 200/61.64 |
| 1,347,506 | 7/1920 | Gordon | 340/542 |
| 1,399,170 | 12/1921 | Vandevelde | 340/542 |
| 3,147,468 | 9/1964 | Daniels | 200/61.68 |
| 3,385,086 | 5/1968 | Partriquin | 70/434 |
| 3,603,958 | 7/1971 | Wehlberg | 340/274 |
| 3,714,644 | 1/1973 | Hellstrom | 340/274 |
| 3,993,987 | 11/1976 | Stevens | 340/274 R |
| 3,995,464 | 12/1976 | Terry | 70/434 |
| 4,091,866 | 5/1978 | Curatolo | 200/61.68 |
| 4,129,865 | 12/1978 | Randall | 340/542 |
| 4,233,595 | 11/1980 | Landkammer | 340/542 |
| 4,390,867 | 6/1983 | Queren | 340/542 |
| 4,394,644 | 7/1983 | DiLeo | 340/571 |
| 4,453,390 | 6/1984 | Moritz | 70/434 |
| 4,465,997 | 8/1984 | Hines | 340/542 |
| 4,559,796 | 12/1985 | DeForrest, Sr. | 70/434 |
| 4,760,380 | 7/1988 | Quenneville | 340/542 |
| 4,763,937 | 8/1988 | Sittnick, Jr. | 292/251.5 |
| 4,845,471 | 4/1989 | Chu | 340/542 |
| 4,912,456 | 3/1990 | Mickel | 340/542 |

*Primary Examiner*—Eric K. Nicholson
*Assistant Examiner*—Darnell Boucher
*Attorney, Agent, or Firm*—Rogers, Bereskin & Parr

[57] ABSTRACT

A lock monitor for fitting to lockable objects that have locks that incorporate a bolt mechanism incuding a slidable bolt and mortise. The opening of the mortise is larger in at least one dimension than the engaging face of the slidable bolt. The lock monitor comprises a status indicator, a contact member mountable to the bolt mechanism adjacent to the slidable bolt and it communication with the status indicator, and an actuating arm mountable on the slidable bolt such that the actuating arm engages the contact member when the slidable bolt is disengaged from the mortise. When the actuating arm engages the contact member it causes the status indicator to register a change in status in the lock.

12 Claims, 3 Drawing Sheets

LOCK MONITOR

FIELD OF THE INVENTION

The present invention relates to a lock monitor, and in particular to a lock monitor that fits most existing slidable bolt and mortise locks.

DESCRIPTION OF THE PRIOR ART

The need for security and the desire for peace of mind are increasingly important nowadays. Many people feel unsafe unless their residences are locked or guarded against intruders. Some people have a guard dog or a sophisticated alarm system to warn against intruders, but most people rely mainly upon the deterrence provided by sturdy door and window locks. Typically these locks are of the bolt variety, where a form of slidable bolt located on the door or window is received by a mortise located in the door frame or window frame. Such locks provide a reasonable degree of security against intruders and are found in most homes.

Regardless of their strength, locks are useless if left open. Many people, especially the elderly, worry constantly about whether they have left the locks of their doors and windows open. It is therefore desirable to have some form of monitor for indicating when a lock is disengaged. Such a system, in addition to improving security, provides peace of mind and allows a person to relax in their place of residence knowing that their doors and windows are actually locked. Such a system may also serve to remind people to lock their doors when they are leaving their homes. Finally, such a system may provide an alarm deterrent to intruders who succeed in forcing open the slidable bolt or who have a copy of the key.

Monitoring systems that respond to the opening and closing of a bolt lock are known. Typically the monitoring systems require the installation of an entirely new lock mechanism, or a modification of an existing mechanism. When an existing lock mechanism is being modified to install a lock monitoring system, drilling is often required to fit the monitoring mechanism to the lock mechanism. Such drilling can permanently disfigure the door or window. If it is desired to subsequently install a new lock mechanism, the door or window may have to be replaced if too much material has been drilled or removed. It is therefore desirable to have a lock monitor that is inexpensive, and that may be installed with little or no drilling or other disfigurement to the door or window.

SUMMARY OF THE INVENTION

A lock monitor is provided for fitting to lockable objects that have locks that incorporate a bolt mechanism including a slidable bolt having an engaging face at the free end thereof and a mortise. The opening of the mortise is larger in at least one dimension than the engaging face of the slidable bolt. The lock monitor comprises an electrically operated status indicator, an actuating arm attachable to the engaging face of the slidable bolt, where the actuating arm extends generally perpendicular to the direction of movement of the slidable bolt, a contact plate attachable to the bolt mechanism adjacent to the engaging face of the slidable bolt, and first and second circuit contacts located on the contact plate. The first and second circuit contacts are connected in a circuit monitored by the status indicator, with the first and second circuit contacts being separated and insulated from each other such that the circuit remains open until the separation between the first and second circuit contacts is bridged by engagement with the actuating arm when the slidable bolt is disengaged from the mortise. When the actuating arm engages the first and second circuit contacts it causes the status indicator to register a change in status in the lock.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which.

DESCRIPTION OF THE PREFERRED EMBODIMENT

Figure 1:
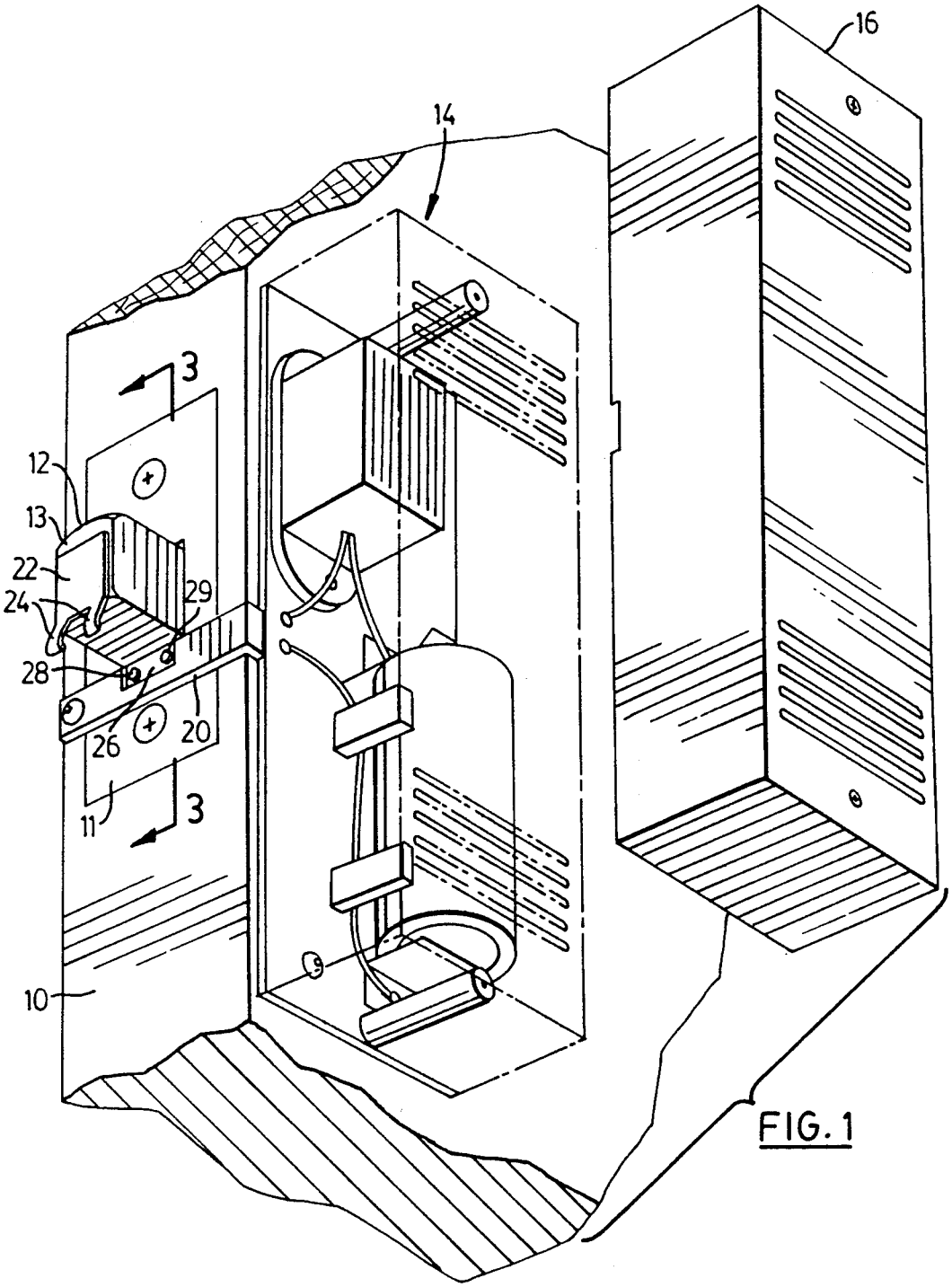
FIG. 1 shows a perspective view of a bolt mechanism mounted in a door, and a lock monitor according to the present invention.

FIG. 1 depicts the preferred embodiment of a lock monitor affixed to a lockable object, in this case a door. The body of the door is generally indicated at 10 with the bolt mechanism indicated at 11. The bolt mechanism 11 includes a slidable bolt 12. The engaging face of the slidable bolt is shown at 13 and the mortise is shown at 15.

The status indicator 14, as shown in FIG. 1, is electrically operated and includes a battery operated audible alarm. The alarm and the battery are located within the status indicator housing 16. In the preferred embodiment, the alarm and battery are connected by a simple series circuit that is also connected to the contact means 26. Conceivably the status indicator 14 could be simplified and its size reduced by means of a printed circuit. The status indicator may take a range of forms. Electrically operated status indicators could incorporate a range of audible and visual alarms including buzzers, lights or LED displays. The status indicator housing 16 may be fastened to the interior or exterior face of the door or window by fastening means. A range of fastening means is conceivable, including screws, glue or two-sided tape.

The actuating arm 22 is affixed to the engaging face 13 of the slidable bolt 12. It is necessary that the mortise 15 have a sufficiently greater area than the area of the engaging face 13 so that the overhanging edge 24 of the actuating arm 22 can freely enter and exit the mortise when the slidable bolt 12 is engaged and disengaged. Many slidable bolt and mortise locks have a mortise that is elongated in one direction. Door locks for instance would typically have a mortise elongated relative to the top and bottom of the door. Consequently, in the case of a typical door lock, the actuating arm 22 may be affixed to the engaging face 13 of the slidable bolt 12 such that the overhanging edge 24 overhangs the upper or lower edge of the engaging face 13 relative to the door. An example of a door where the overhanging edge 24 overhangs the lower edge of the engaging face 13 is shown in FIG. 1.

Extending from the housing 16 is a contact plate 20 one end of which is situated over the bolt mechanism 11 at the edge of the door adjacent to the engaging face 13 of the slidable bolt 12. The contact plate 20 carries the contact means 26. In the preferred embodiment, the contact plate is "L" shaped such that the plate may extend over the bolt mechanism 11 from the back of the housing 16. The part of the contact plate 20 that is situated over the bolt mechanism 11 may be attached to the edge of the door to ensure that the contact means 26 remain in a position to engage the actuating arm 22. Attachment means may include screws, glue, or two-sided tape. Other embodiments of the contact plate are conceivable including a contact plate that does not extend from the housing 16 but rather is attached directly to the bolt mechanism at the edge of the door or window adjacent to the slidable bolt 12. In such a case, the contact plate 20 must still be capable of communicating with the status indicator 14. This communication would most likely be provided by electrical wires running from the contact means 26 located on the contact plate 20 to the status indicator 14 located in the housing 16.

Figure 4:
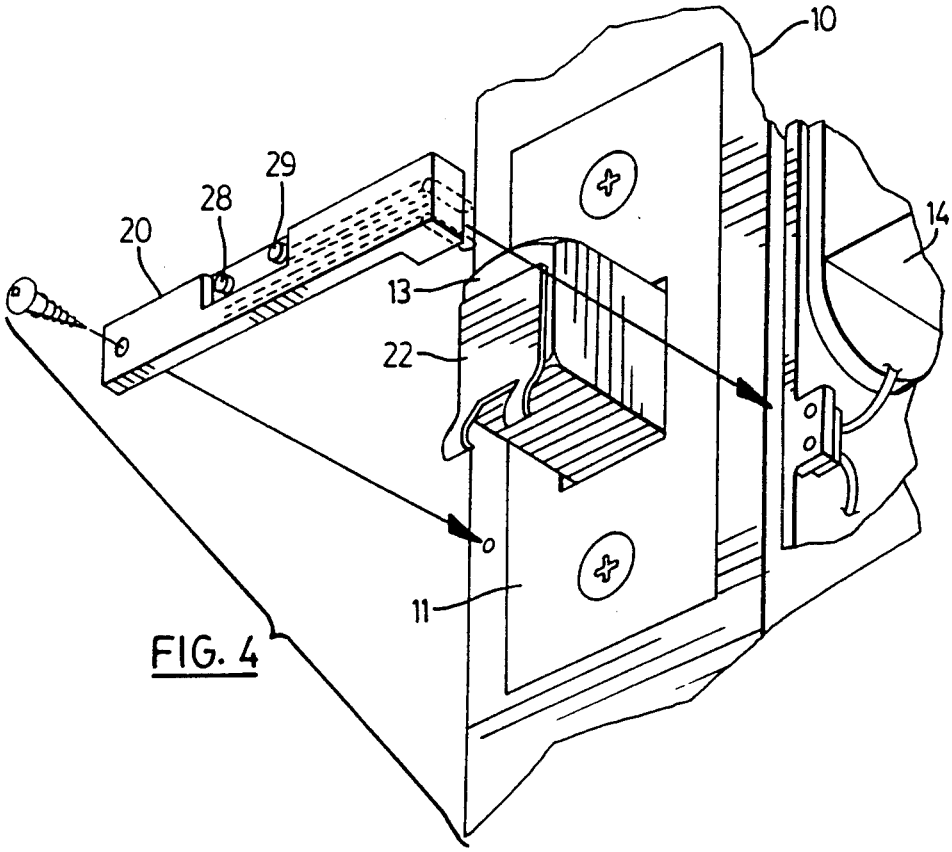

The contact plate 20, in the preferred embodiment, is integrally connected to the housing 16. In order that the lock monitor may be fitted to various lockable objects, such as right or left opening doors, the status indicator 14 may be inverted so that the contact plate 20 extends from the side of the housing 16 adjacent the bolt mechanism. In an alternative embodiment, the contact plate 20 may be releasably connected to the housing 16. A range of means for releasably connecting the contact plate to the housing are conceivable, including pin and as shown in FIG. 4. Releasable connecting means may be located on each side of the housing so that the contact plate may be attached to the side of the housing adjacent to the bolt mechanism.

The contact plate 20 should be sufficiently thin to be able to slip into the gap normally present between a door and door jamb. In the preferred embodiment, the contact plate 20 has a thickness of approximately two millimeters. The contact means 26 may be recessed within the contact plate 20 to minimize the thickness of the contact plate.

The contact plate 20 has first and second circuit contacts 28 and 29. These circuit contacts act as a contact means 26. They are separated a distance not exceeding the width of the overhanging edge 24 of the actuating arm 22. The separation between the first and second circuit contacts 28, 29 is insulated such that an electric current cannot pass between them through the contact plate 20. Each circuit contact 28, 29 is connected to a wire communicating with the status indicator 14. In the preferred embodiment, the circuit contacts are connected in a series circuit with the status indicator. The insulated separation between the circuit contacts 28, 29 creates an open circuit. When the slidable bolt 12 is disengaged from the mortise 15 the actuating arm 22 engages the circuit contacts 28, 29 and the circuit is closed. Once the circuit is closed, the status indicator depicted in FIG. 1 will indicate the change in status by way of an audible alarm.

The contact means 26 may take alternative forms provided that it accurately senses the actuating arm 22 when the slidable bolt 12 is disengaged from the mortise 15. For example the contact means could comprise a pair of contacts that are normally closed, but which are opened by the actuating arm 22.

The preferred embodiment as shown in FIG. 1 depicts the actuating arm 22 mounted on the engaging face 13 of the slidable bolt 12. The overhanging edge 24 of the actuating arm is shown facing the bottom edge of the door 10 in FIG. 1, however, as stated earlier, it is conceivable that the actuating arm could overhang any edge of the engaging face 13 of the slidable bolt 12. The important requirement is that the overhanging edge 24 be in a position to engage the contact means 26 when the slidable bolt 12 is disengaged from the mortise. In particular, with respect to the preferred embodiment, the overhanging edge 24 must be in a position to engage the first and second circuit contacts 28, 29 when the lock is disengaged. The overhanging edge 24 of the actuating arm 22 should be constructed from a resilient conducting material that allows a small current to pass between the first and second circuit contacts when the overhanging edge engages the contact point.

The actuating arm 22 may conceivably be an integral part of the engaging face 13 of the slidable bolt 12, however the preferred embodiment as shown in FIG. 1 depicts the actuating arm 22 as a simple modification of an existing lock mechanism. The actuating arm 22 may be attached to the engaging face 13 of the slidable bolt 12 by fastening means. A range of fastening means is conceivable, including glue, two-sided tape, or a screw.

Figure 2:
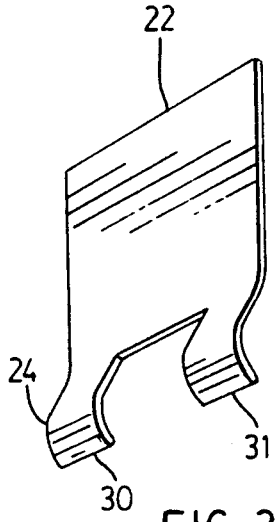
FIG. 2 shows an enlarged perspective view of the actuating arm of the lock monitor.

The overhanging edge 24 of the actuating arm 22, as shown in FIGS. 1 and 2, is divided into two forks 30 and 31. The forks are separated by a distance generally equal to the separation between the circuit contacts 28 and 29 so that they engage the circuit contacts when the slidable bolt 12 is disengaged. The forked overhanging edge 24 ensures a firm contact with each circuit contact 28, 29 in situations where the contact plate 20 is uneven, or where the engaging face 13 of the slidable bolt is not square with the edge of the door or window. The forks are not essential to the invention however, since the overhanging edge 24 could comprise a single piece capable of contacting both circuit contacts 28, 29.

Figure 3:
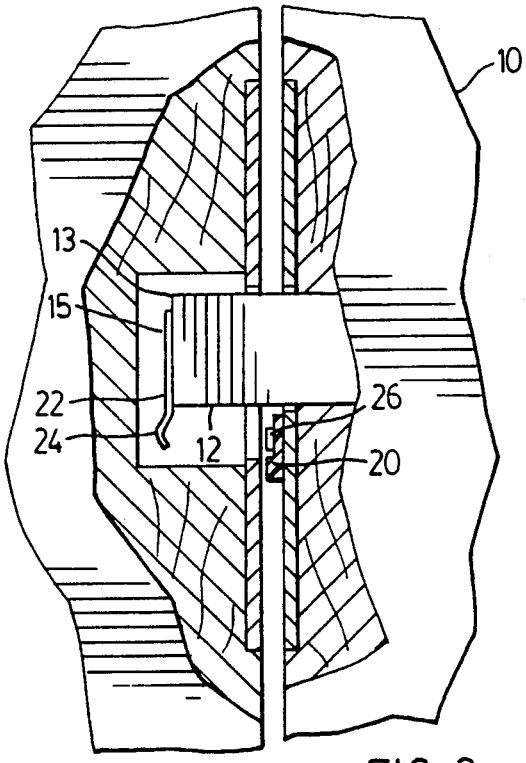
FIG. 3 shows a sectional view of the lock monitor as viewed along line 3—3 in FIG. 1; and, FIG. 4 is a perspective view of a portion of the lock monitor of the present invention showing an embodiment having a releasable contact plate.

The overhanging edge 24 of the actuating arm in the preferred embodiment is arched as is shown in FIGS. 2 and 3. The arching enables the actuating arm to maintain contact with the circuit contacts 28, 29 even when the slidable bolt 12 is recessed within the door 10.

Figure 5:
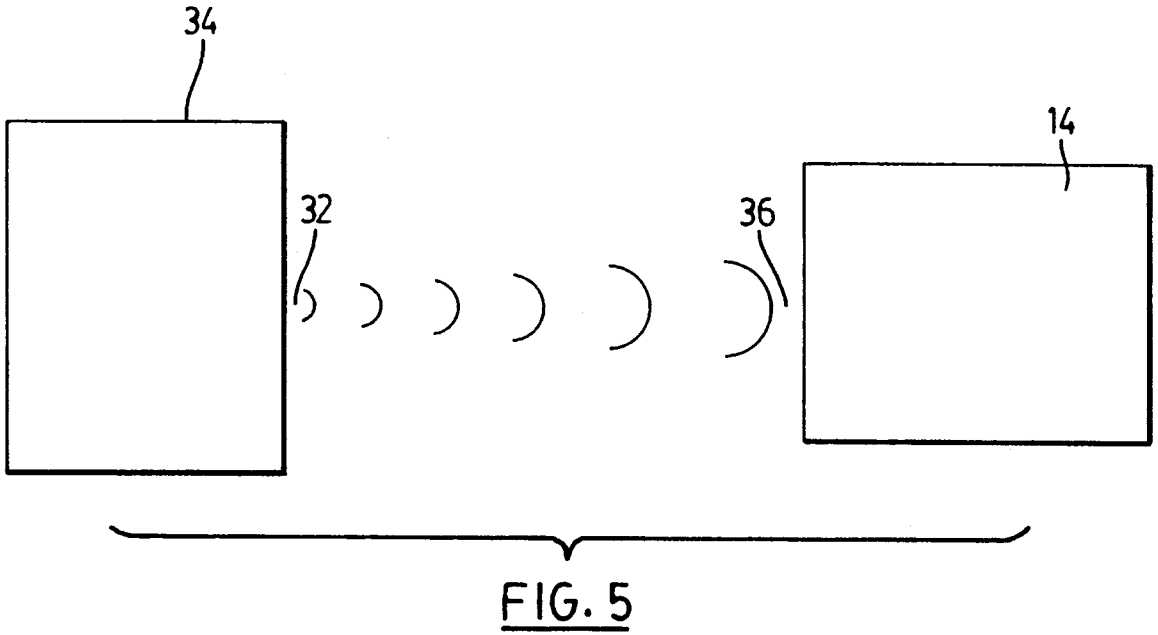
FIG. 5 is a schematic diagram showing an embodiment having a transmitter and receiver.

The lock monitor as described in the present invention comprises several elements that may be arranged in a number of ways. The arrangement shown in FIG. 1 is preferred for its ease in fitting the lock monitor to an existing slidable bolt and mortise lock. More sophisticated arrangements are conceivable however. For instance, a transmitter 32 may be connected to the circuit including the first and second circuit contacts. The transmitter 32 could be located in a transmitter housing 34 fastened to the door by fastening means including glue, two-sided tape, or screws. The transmitter could in turn communicate with a receiver 36 connected to the status indicator which would be located at an external location. This arrangement is depicted schematically in FIG. 5. It is conceivable that such an arrangement could have one centrally located status indicator that is responsible for all the doors and windows in the home. Thus, at a glance, a person can determine if all the locks are engaged.

It is to be understood that what has been described are preferred embodiments of the invention. The invention nonetheless is susceptible to certain changes and alternative embodiments fully comprehended by the spirit of the invention as described above and the scope of the claims set out below.

I claim:

1. A lock monitor for fitting to lockable objects that have locks that incorporate a bolt mechanism including a slidable bolt having an engaging face at the free end thereof and a mortise, where the opening of said mortise is larger in at least one dimension than said engaging face of said slidable bolt, said lock monitor comprising:

an electrically operated status indicator;

an actuating arm attachable to the engaging face of said slidable bolt, where said actuating arm extends generally perpendicular to the direction of movement of said slidable bolt;

a contact plate attachable to said bolt mechanism adjacent to said engaging face of said slidable bolt; and first and second circuit contacts located on said contact plate, said first and second circuit contacts being connected in a circuit monitored by said status indicator, with said first and second circuit contacts being separated and insulated from each other such that said circuit remains open until the separation between said first and second circuit contacts is bridged by engagement with said actuating arm when said slidable bolt is disengaged from said mortise, said engagement between said actuating arm and said first and second circuit contacts causing said status indicator to register a change in status of said lock.

2. A lock monitor as claimed in claim 1, wherein said lock monitor further includes a status indicator housing.

3. A lock monitor as claimed in claim 2 wherein said status indicator includes fastening means for fastening said status indicator housing to said lockable object.

4. A lock monitor as claimed in claim 3, wherein said contact plate extends from said status indicator housing.

5. A lock monitor as claimed in claim 4, wherein said first and second circuit contacts are recessed within said contact plate.

6. A lock monitor as claimed in claim 5, wherein said contact plate is "L" shaped such that it extends from said status indicator housing to a location adjacent to said engaging face of said slidable bolt.

7. A lock monitor as claimed in claim 6, wherein said contact plate is releasably connected to said status indicator housing.

8. A lock monitor as claimed in claim 7, wherein said actuating arm includes first and second forks, said first and second forks being spaced to engage said first and second circuit contacts when said slidable bolt is disengaged from said mortise.

9. A lock monitor as claimed in claim 8, wherein said actuating arm is arched at one end such that said arched end engages said first and second circuit contacts when said slidable bolt is disengaged from said mortise.

10. A lock monitor as claimed in claim 1, further comprising a transmitter connected to said circuit and a receiver connected to said status indicator such that said transmitter will communicate with said receiver when said circuit is open or closed.

11. A lock monitor as claimed in claim 10, further comprising a transmitter housing.

12. A lock monitor as claimed in claim 11, wherein said transmitter and said transmitter housing are fastened to said lockable object by fastening means.

* * * * *